United States Patent [19]

Hamilton et al.

[11] Patent Number: 4,674,650

[45] Date of Patent: Jun. 23, 1987

[54] CONTAINER AND COVER FASTENING MEANS

[75] Inventors: Edward H. Hamilton, Wilmington, Del.; Ralph M. Onstenk, Papendrecht; Bernardus A. Lesscher, Harbrink Hoek, both of Netherlands

[73] Assignees: E. I. Du Pont de Nemours and Company, Wilmington, Del.; Wavin B. V., Zwolle, Netherlands

[21] Appl. No.: 895,593

[22] Filed: Aug. 14, 1986

Related U.S. Application Data

[63] Continuation of Ser. No. 784,731, Oct. 7, 1985, abandoned.

[51] Int. Cl.[4] ..... B65D 45/32

[52] U.S. Cl. ..... 220/319; 220/355; 220/358; 220/320

[58] Field of Search ..... 220/306, 308, 319, 320, 220/355, 358; 15/55

[56] References Cited

U.S. PATENT DOCUMENTS

| | | | |
|---|---|---|---|
| 3,474,928 | 10/1969 | Hurtt | 220/306 |
| 3,510,023 | 5/1970 | Ullman et al. | 220/320 |
| 3,519,163 | 7/1970 | Bardell | 220/306 |
| 3,664,544 | 5/1972 | Hammes | 220/308 |
| 4,177,934 | 12/1979 | Hammes et al. | 220/320 |

*Primary Examiner*—George T. Hall

[57] ABSTRACT

A plastic container with an inverted V-shaped rim at the upper edge of its body. The rim configuration makes it easy to pour contents from the container and, after pouring, any material remaining on the rim will slide off. A cover with a V-shaped flange mates with the rim which holds it out of contact with the inner and outer surface of the body wall. The cover also has a pocket containing a sealing ring which is passed against the rim by a locking strap to seal the container.

7 Claims, 2 Drawing Figures

CONTAINER AND COVER FASTENING MEANS

This application is a continuation of application Ser. No. 784,731, filed Oct. 7, 1985, now abandoned.

BACKGROUND OF THE INVENTION

1. Field of the Invention

This invention is a container and, more particularly, it is directed to a container having a body made of resilient plastic material and a removable plastic cover sealed thereto.

2. Description of the Related Art

Containers made of plastic are known to the art. They possess many advantages over paper, wood or metallic containers, particularly when packaging materials such as resins or liquids.

In the past, it was common practice to ship resins, such as polytetrafluoroethylene resin, in fiber or paperboard containers or drums with a moistureproof gasket in the lid, generally made of metal, to prevent moisture absorption by the product. More recently, the design of this drum has been modified to incorporate a plastic liner or plastic foil barrier in the sidewall. In addition, the cover or lid design has been changed to a high density polyethylene construction to replace the varnished or lacquered lid.

These changes have improved the container but did not solve certain basic problems such as moisture absorption through the drum sidewall during periods of high humidity, sidewall fatigue, rust on the drum chimes and locking band, and gasket material adhering to the metal chimes. All of these factors have contributed to the deterioration and contamination of the resin packaged in the drum.

The use of an all-plastic container for packaging resins or similar materials has eliminated all or most of these problems; however, the designs have been complex and the mating rim/closure configurations required for proper closure have been such as to make it difficult to pour the contents from the container and, frequently, because of the surface configurations, material is left on portions of the rim or container sidewall after pouring. Additionally, in such designs, the cover is sometimes difficult to seal to avoid moisture problems or to reseal when all the resin is not immediately used, or when the container is used again. This has presented a challenge to the packaging arts and many attempts, and many designs, have evolved to solve these and other problems.

A typical solution of the closure problem is seen in U.S. Pat. No. 3,519,163 to Bardell which shows a "snap-on" closure for a plastic container having a U-shaped channel adapted to fit over the open end of the side wall structure and having an interlocking bead to hold it in place on the container. Another tapered bead is molded into the apex of the channel or a separate resilient sealing gasket is positioned in such apex to resiliently contact the open end of the container when the closure is applied in order to effect a fluid-tight seal between the closure and container. Other sealing arrangements such as tubular gaskets, flowed-in gaskets, and the like may also be provided within the channel in order to effect a fluid-tight seal between the closure and the container body. The walls of the channel are in contact with the inner and outer surfaces of the side wall structure and the inner wall of the channel projects into the container body when the closure is in place. The upper rim of the side wall is curved and presents a surface on which the U-shaped channel rests.

Another similar container of the prior art is seen in U.S. Pat. No. 3,474,928 to Hurtt which also shows a "snap-on" cover with a frusto-conically shaped surface defining an acute angle with a locking surface on the side wall of the container to permit the cover to be easily removed. The cover has a shoulder extending into the container and in contact with the inner surface of such container. The top of the container rim is flat.

U.S. Pat. No. 3,664,544 to Hammes shows still another all-plastic container in which a strap is used to urge a sealing gasket confined within an annular rim portion of the cover into contact with an annular section or extension of the wall of the body portion of the container to seal the cover to the body portion. The design is complex and the annular section of the body portion curves in an S-shape over the opening of the container.

The containers of these patents, while effective for many uses, in one particular or another, fail to meet all of the needs of a container for packaging materials, such as resins, which require very careful handling.

As an example, it is important when packaging resins, or other materials, to prevent contact by the cover which would "shear" or "smear" the resin particles. This could occur if residual particles remain on the lip or rim of the container after the resin is poured out of the container and the lid or cover replaced. Further, particles might become entrapped between a portion or extension on the cover which extends into the container and abuts the inner surface of the container, as shown in the Hurtt and Bardell patents discussed above, for example, and cause the same problem. And the rim design should be such as to minimize the presence of particles on their surface after pouring. If the rim surface is of the type shown in the prior art this, too, presents a major problem. And, of course, the container must also be easy to pour with no material caught on the body extension. This latter problem is particularly evident in the Hammes container discussed above.

This invention solves the problems of the prior art by providing an all plastic container having a novel inverted V-shaped rim extending outwardly from the opening of the container body, which makes it easy to pour material from the container and which rim is angled so that any residual particles remaining on their surface will slide off and, hence, present no problems of "shear" or "smear" when the cover is replaced. The cover, in turn, has a mating V-shaped surface into which the rim fits for easily and properly positioning the cover on the container. The cover also has a pocket containing a sealing ring or gasket and a locking strap is provided to urge this ring into sealing contact with a surface of the rim to form a novel sealed container.

SUMMARY OF THE INVENTION

Briefly described, this invention is a container comprising a body and a cover which is sealable thereto. The body is substantially cylindrical and has a wall with an inner surface defining an opening at its upper edge.

A cover positioning and sealing rim is integral with the wall at the upper edge of the body. This rim is resilient and has a conic outer first surface extending outwardly and upwardly from the opening whereby the contents in the container may be poured therefrom without impediment and whereby any such contents still in contact with this surface, after pouring, will tend to slide back into the container prior to connecting or reconnecting the cover to the container.

The rim further has a conic outer second surface extending outwardly and downwardly from the first surface whereby any residual contents from the container in contact with this surface will tend to slide off such surface and away from the container prior to connecting or reconnecting the cover to the container.

Preferably the flat first and second surfaces of the rim are at an angle of about 45° to the inner and outer surfaces of the wall of the body whereby any contents of the container in contact therewith will slide from such surfaces.

The cover is also substantially cylindrical and has a closure part having a lower surface for closing the opening in the container.

A cover positioning and sealing flange is integral with the outer edge of the closure part. This flange is resilient and has an inner first surface extending upwardly and outwardly from the outer edge of the closure part and an inner second surface extending outwardly and downwardly from the first surface. These first and second surfaces of the flange are adapted abuttingly to contact the first and second surfaces of the rim when the cover is placed on the body and thereby assure that the cover is properly positioned and, thus positioned, help seal the cover to the body. The cover and body are designed so that the cover only contacts the rim and not the inner or outer surfaces of the wall of the container body.

The cover flange further has an inner third surface extending from the second surface and which defines a pocket for receiving a sealing ring. The flange further has an upper fourth surface and an outer fifth surface which define with portions of the third surface a resilient flange extension extending downwardly from the main portion of the flange.

A resilient sealing ring is positioned in the pocket of the cover flange and a sealing means or sealing strap is positioned in abutting contact with the outer fifth surface of the flange whereby resiliently to urge the sealing ring into abutting contact with the outer second surface of the rim and thereby seal the cover to the body to form a sealed container.

When the container is sealed the inner surface of the sealing strap is further in abutting contact with at least a portion of the sealing rim and, in a preferred embodiment, the cover further includes a resilient rim extension extending downwardly from the outer edge of the second surface of the rim. This extension is parallel to the wall of the body of the container and spaced therefrom and the inner surface of the strap is further in abutting contact with the outer surface of this rim extension.

Preferably both the cover and the body of the container are formed of plastic.

This invention solves problems existent in the prior art by providing a container having a novel rim extending outwardly from the opening of the body. This rim permits the contents to be easily poured from the container and spaces the cover out of contact with the body wall when the container is closed. Further the inverted V-shaped configuration of the rim prevents the contents from remaining on the rim surface after pouring and, thus, from being "sheared" or "smeared" by and between the cover and body when the cover is replaced. And, lastly, the cover has a mating V-shaped surface configuration for receiving the rim and a sealing gasket in a pocket on its lower surface. Accordingly, when a sealing strap is brought into contact with the flange on the cover this gasket is urged into sealing contact with the rim to form a novel sealed container.

DESCRIPTION OF THE PREFERRED EMBODIMENT

Figure 1:
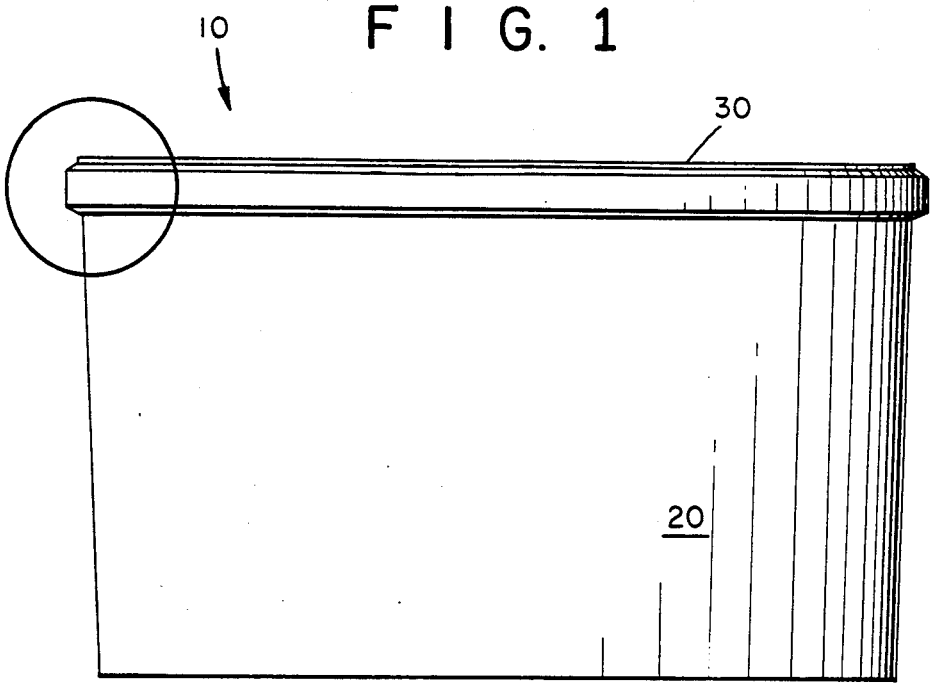
FIG. 1 is an elevational view of a container of this invention.
Figure 2:
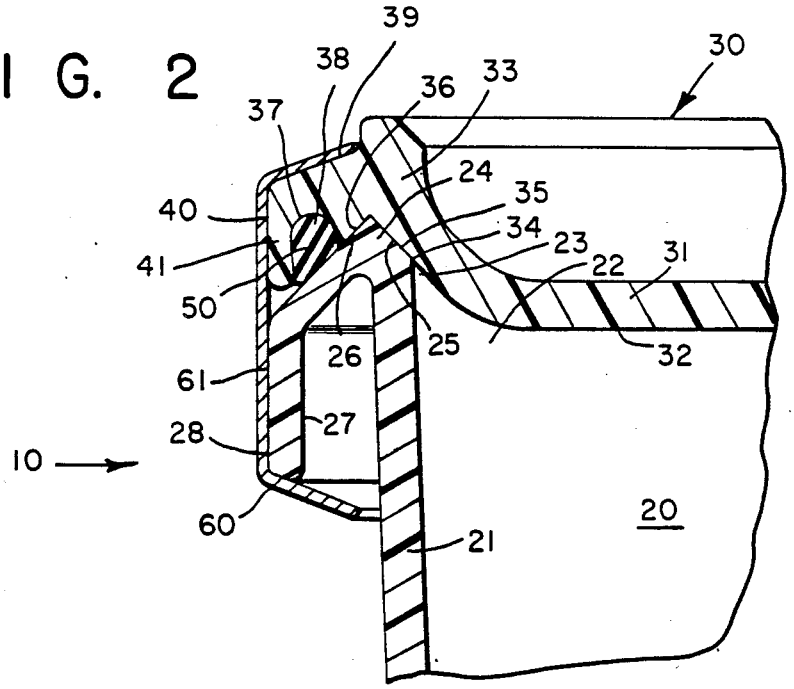
FIG. 2 is an enlarged cross section of the area encircled in FIG. 1.

A preferred container 10 of this invention is shown in FIG. 1. It comprises a body 20 and a cover 30 which may be easily sealed, or resealed, to such body 20, as will later be described.

Preferably both the body 20 and the cover 30 are made entirely of a plastic material. For example they can be injection-molded of any thermoplastic resin such as low or high density polyethylene, polypropylene, polystyrene, nylon, polyamide, melamine or ionomer, as is desired.

The body 20 is preferably substantially cylindrical and includes a wall 21 having an inner surface defining an opening 22 at the upper edge 23 of the wall.

A cover positioning and sealing rim 24 is integral with the wall 21 at the upper edge of the body. This rim 24 is resilient and has a conic outer first surface 25 extending outwardly and upwardly from the opening 23 whereby the contents in the container may be poured therefrom without impediment and whereby any such contents still in contact with this surface 25, after pouring, will tend to slide back into the container prior to connecting or reconnecting the cover to the container.

The rim 24 further has a conic outer second surface 26 extending outwardly and downwardly from the first surface 25 whereby any residual contents from the container in contact with this surface 26 also will tend to slide off such surface and away from the container prior to connecting or reconnecting the cover to the container.

Preferably the first and second surfaces 25 and 26 of the rim 24 are at an angle of about 45° to the inner and outer surfaces of the wall 21, respectively, whereby any contents of the container in contact therewith will slide from such surfaces.

The container 10 has a cover 30 removably connected to the body 20.

The cover is also substantially cylindrical and has a closure part 31 having a lower surface 32 for closing the opening in the container.

A cover positioning and sealing flange 33 is integral with the outer edge 34 of the closure part. This flange 33 is resilient and has an inner first surface 35 extending upwardly and outwardly from the outer edge 34 of the closure part and an inner second surface 36 extending outwardly and downwardly from the first surface 35. These first and second surfaces 35 and 36 of the flange 33 are adapted abuttingly to contact the first and second surfaces 25 and 26 of the rim 24 when the cover 30 is placed on the body 20 and thereby assure that the cover is properly positioned. The cover 30 and body 20 are designed so that the cover 30 only contacts the rim 24 and not the inner or outer surfaces of the wall 21 of the container body.

The cover flange 33 further has an inner third surface 37 extending from the second surface 36 and which defines a pocket 38 for receiving a sealing ring. The flange further has an upper fourth surface 39 and an outer fifth surface 40 which define with portions of the third surface 37 of resilient flange extension 41 extending downwardly from the main portion of the flange 33.

A resilient or highly elastic sealing ring or gasket 50 is positioned in the pocket 38 of the flange 33 and a sealing means or sealing strap 60 is positioned in abutting contact with the outer fifth surface 40 of the flange 33 whereby resiliently to urge the sealing ring 50 into abutting contact with the outer second surface 26 of the rim 24 and thereby seal the cover 30 to the body 20 to form a sealed container.

When the container is sealed the inner surface 61 of the sealing strap 60 further may be in abutting contact with at least a portion of the sealing rim 24 and, in a preferred embodiment, the body 20 further includes a resilient rim extension 27 extending downwardly from the outer edge of the second surface 26 of the rim. This extension 27 is parallel to the wall 21 of the body of the container and spaced therefrom and the inner surface 61 of the strap 60 is further in abutting contact with the outer surface 28 of this rim extension 27.

Preferably both the cover and the body of the container are formed of plastic.

This invention solves problems existent in the prior art by providing a container having a novel rim 24 extending outwardly from the opening 22 of the body of the container. Such rim 24 permits the contents to be easily poured from the container and spaces the cover 30 out of contact with the body wall 21 when the container is closed. Further the inverted V-shaped configuration of the rim 24 prevents the contents from remaining on the rim 25 and 26 after pouring and, thus, from being "sheared" or "smeared" by and between the cover 30 and body 20 the cover is replaced. And, lastly, the cover 30 has a mating V-shaped surface configuration for receiving the rim 24 and a sealing gasket 50 in a pocket on its lower surface. Accordingly, when a sealing strap 60 is brought into contact with the flange 33 on the cover 30 this gasket 50 is urged into sealing contact with the rim 24 to form the novel sealed container 10 of this invention.

We claim:

1. A container comprising a body and a cover sealably connectable thereto such body being substantially cylindrical and having a wall having an inner surface defining an opening at upper edge thereof, a cover positioning and sealing rim integral with the wall at such upper edge of the body, such rim being resilient and having a conic outer first surface extending outwardly and upwardly from the opening whereby the contents in the container may be poured therefrom without impediment and whereby any such contents still in contact with this surface, after pouring, will slide back into the container prior to connecting or reconnecting the cover to the container, such rim further having a conic outer second surface extending outwardly and downwardly from the first surface whereby any contents from the container in contact with this surface also will slide off such surface away from the container prior to connecting or reconnecting the cover to the container, such cover being substantially cylindrical and having a closure part having a lower surface for closing the opening in the container, a cover positioning and sealing flange integral with the outer edge of the closure part, such flange being resilient and having an inner first surface extending upwardly and outwardly from the outer edge of the closure part and an inner second surface extending outwardly and downwardly from the first surface, such first and second surfaces of the flange being adapted abuttingly to contact the first and second surfaces of the rim when the cover is placed on the body and thereby assure that the cover is properly positioned on the body and, thus positioned, help seal the cover to the body, such flange further having an inner third surface extending from the second surface and defining a pocket for receiving a sealing ring, such flange further having an upper fourth surface and an outer fifth surface which define with portions of the third surface a resilient flange extension extending downwardly from the main portion of the flange, a resilient sealing ring positioned in the pocket of the flange and, a sealing means positioned in abutting contact with the outer fifth surface of the cover flange whereby resiliently to urge the sealing ring into abutting contact with the outer second surface of the rim and thereby seal the cover to the body to form a sealed container.

2. The container of claim 1 wherein the sealing means is a strap having an inner and an outer surface and whereby the inner surface of such strap is further in abutting contact with at least a portion of the sealing rim.

3. The container of claim 1 which further includes a resilient rim extension extending downwardly from the outer edge of the second surface of the rim, such extension being parallel to the wall of the body of the container and spaced therefrom and such extension having an outer surface and wherein the inner surface of such strap is further in abutting contact with such outer surface of the rim extension.

4. The container of claim 1 wherein both the cover and the body of the container are formed of plastic.

5. The container of claim 1 wherein the first and second surfaces of the rim are at an angle of about 45° to the first and second surfaces of the wall of the body whereby any contents of the container in contact therewith will slide from such surfaces.

6. The container of claim 1 wherein the cover and body are designed so that the cover only contacts the rim and not the inner and outer surfaces of the wall of the body when such cover is positioned on such body.

7. The container of claim 5 wherein any contents of the container in contact with the first and second surfaces of the rim will slide from such surfaces and either back into the container or away from the container prior to connecting or reconnecting such cover to such body.

* * * * *